United States Patent [19]

Gunson

[11] 4,048,721

[45] Sept. 20, 1977

[54] SCISSORS

[75] Inventor: Brennand Gunson, Sheffield, England

[73] Assignee: Russell (Shears) Limited, Rawmarsh, near Rotherham, England

[21] Appl. No.: 721,939

[22] Filed: Sept. 10, 1976

[51] Int. Cl.[2] ..... B26B 13/02

[52] U.S. Cl. ..... 30/254; 30/268

[58] Field of Search ..... 30/254, 341, 266, 267, 30/268, 260, 230; 76/104 A

[56] References Cited

U.S. PATENT DOCUMENTS

| | | | |
|---|---|---|---|
| 444,983 | 1/1891 | Krusius | 30/268 |
| 837,590 | 12/1906 | Smith | 30/268 |
| 2,355,364 | 8/1944 | Cohn | 30/260 |
| 2,511,187 | 6/1950 | Weidauer | 30/266 X |
| 2,627,656 | 2/1953 | Richartz | 30/341 X |
| 3,750,282 | 8/1973 | Eaton | 30/254 |

FOREIGN PATENT DOCUMENTS

| | | | |
|---|---|---|---|
| 800,061 | 4/1936 | France | 30/341 |

*Primary Examiner*—Jimmy C. Peters

[57] ABSTRACT

A pair of scissors with molded plastics blades having molded in metal cutting elements, the cutting elements being contained mainly within the blades so that said blades are substantially of sandwich construction and the cutting elements being provided with holes or slots through which the molded material extends.

5 Claims, 16 Drawing Figures

SCISSORS

Figure 1:
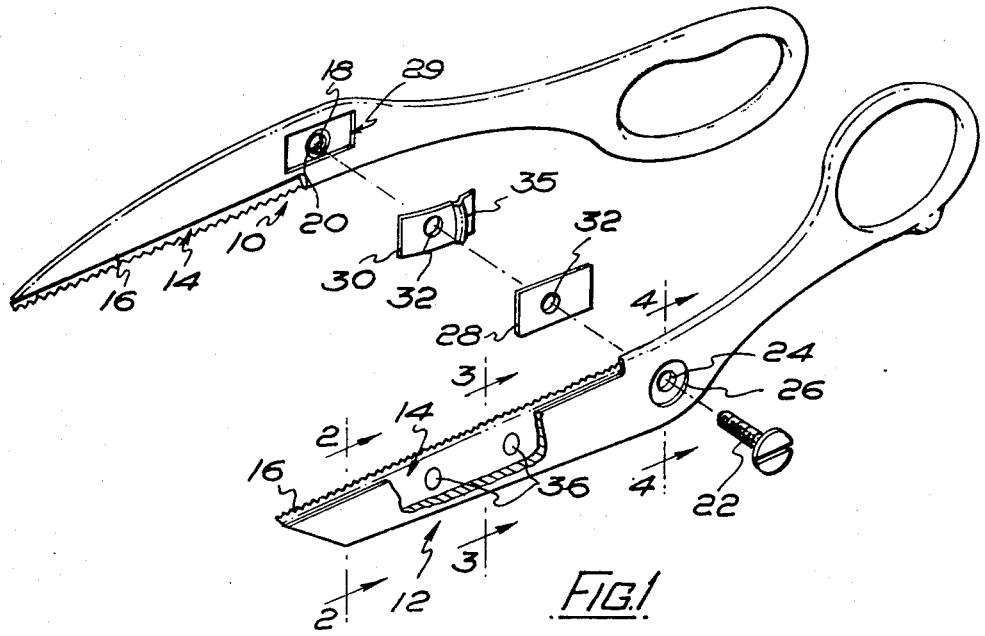

The invention relates to scissors and has for its object to provide an improvement therein..

According to one aspect of the invention, there is provided a pair of scissors the blades of which are each moulded, integral with a connected shank and bow, in a synthetic plastics material or other relatively soft moulding material with a moulded-in cutting element made from metal. The metal cutting element may be made of flat steel strip between 1 m.m. and 3 m.m thick. Alternatively, such cutting elements may be of cast or forged construction in which case their thickness may vary through out their section and length. A marginal edge portion constituting the cutting edge of each metal cutting element will preferably be angled relative to the remainder of the element, the width of the angled edge portion decreasing from the extreme end of the blade to a point at which it runs out at or in the region of a pivot. The angled edge portion constituting the cutting edge of each metal cutting element will preferably be "set" at an angle up to 90° or more to the plane containing the remainder of the element. Each metal cutting element may be provided with a number of round or elongate holes or patterned slots or a series of notches in the rear edge of the cutting element through or around which the moulding material will have flowed to assist the keying of the cutting element in the finished blade. The metal cutting elements may extend beyond the ends of the moulded parts of the blades to facilitate a "pick-up" action on work materials and in this case the extreme ends of the moulded parts of the blades will preferably coincide with an extreme edge portion of one of the holes or slots (which may be of substantially triangular shape) so that the extreme end portions of the moulded parts on opposite sides of each cutting element are joined together and are unlikely to break away. Alternatively, or in addition to this, each metal cutting element may be provided with a waved or lipped edge or engine turned surface to assist the keying of the cutting element in the blade. The cutting elements may be formed with portions which extend beyond the pivot and into the shanks to strengthen the latter, and such a portion of at least one of the cutting elements may be doubled over to form a "ride" portion of the blade. Alternatively, the moulded part of the connected blade and shank may be provided in the region of the pivot with a cavity for the reception of a spring steel element having a ride portion stamp into it, the cavity and spring steel element preferably being of square or rectangular shape so that the element cannot turn within the cavity. Each blade, connected shank and bow portion may be identical in size and shape to the other or may be different from the other as required. One blade may have a screwthreaded bush moulded in it for the reception of a pivot screw.

Figure 2:
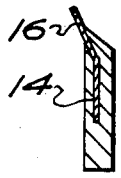
Figure 3:
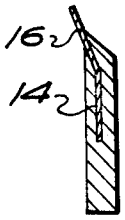
Figure 4:
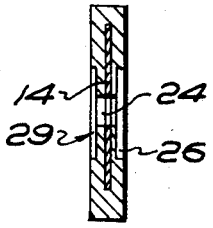
Figure 5:
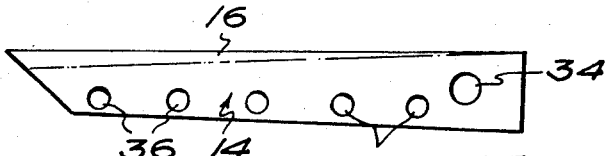
Figure 6:
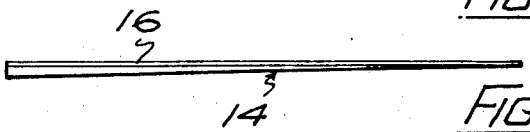
Figure 7:
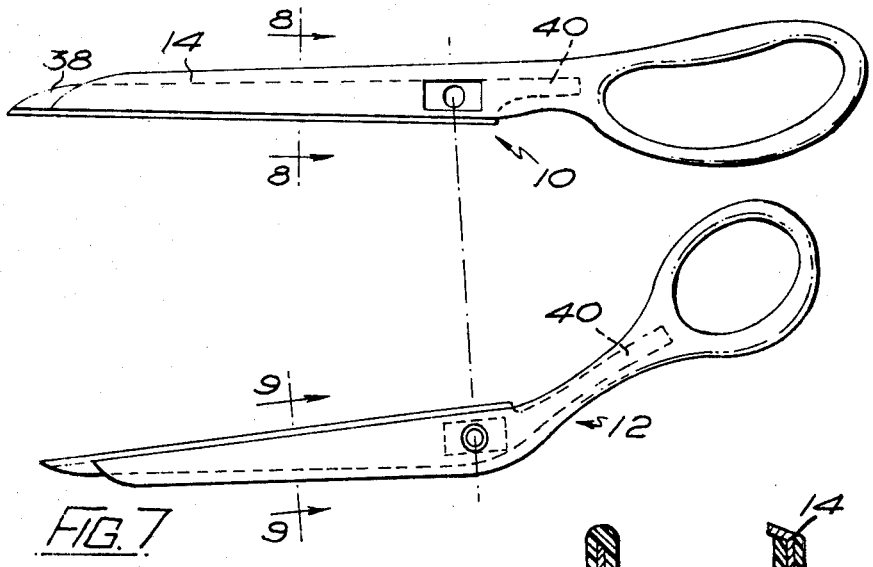
Figure 8:
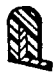
Figure 9:
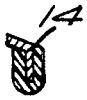
Figure 10:
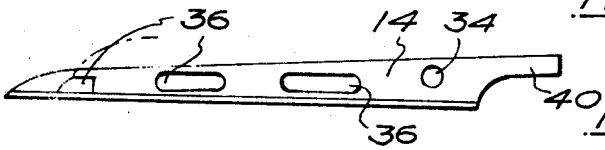

According to another aspect of the invention, a method of making a pair of scissors includes the steps of forming metal cutting elements from flat metal strip, or from cast or forged metal; locating said cutting elements in dies in which the scissor blades are to be moulded in a synthetic plastics material or other relatively soft moulding material; and injecting the moulding material into said dies so that it surrounds said cutting elements with marginal edge portions thereof projecting therefrom. The method may also include the step of locating a screwthreaded bush in one of the dies before the moulding operation so that in the finished blade it provides a screwthreaded hole for the reception of a pivot screw. The method will preferably include the initial step of forming each metal cutting element with a marginal edge portion angled relative to the remainder of the element so as to constitute the cutting edge of the finished blade, and may include the step of forming each metal cutting element with a number of holes or other irregularities through or around which the moulding material can flow during the subsequent moulding operation to assist the keying of the cutting element in the finished blade. In order that the invention may be fully understood and readily carried into effect, the same will now be described, by way of example only, with reference to the accompanying drawings, of which:

FIG. 1 is an exploded view of the component parts of a pair of scissors embodying the invention, FIGS. 2,3 and 4 are sectional views on the lines 2—2, 3—3 and 4—4 respectively in FIG. 1, FIGS. 5 and 6 are respectively side and plan views of a metal cutting element which will presently be referred to, FIG. 7 is a view similar to FIG. 1 and illustrating another pair of scissors embodying the invention, FIGS. 8 and 9 are sectional views on the lines 8—8 and 9—9 respectively in FIG. 7, FIG. 10 is a side view of a metal cutting element of the scissors shown in FIG. 7

Figure 11:
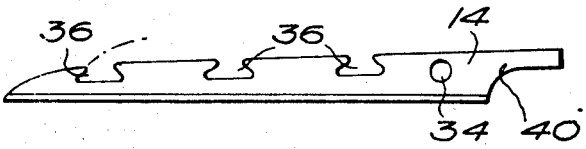
Figure 12:
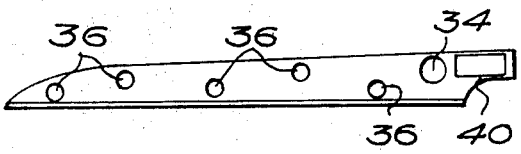
Figure 13:
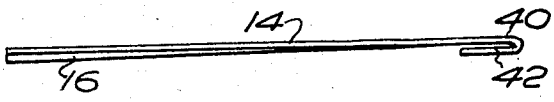

FIGS. 11 and 12 are views similar to FIG. 10 and showing different forms of metal cutting element which could be used, FIG. 13 is a plan view of the kind of metal cutting element shown in FIG. 12, and FIGS. 14 to 16 are views similar to FIGS. 8 and 9 which will presently be referred to. Referring now to FIGS. 1 to 6 of the drawings, the pair of scissors there illustrated includes a pair of blades 10 and 12 moulded in a synthetic plastics material integral with respective shanks and bows.

Each blade is provided with a moulded-in metal cutting element 14 which has been made from flat steel strip approximately 1 m.m to 3 m.m thick. As shown in the sectional views, FIGS. 2 to 4, a marginal edge portion 16 constituting the cutting edge of each metal cutting element is angled relative to the remainder of the element, the angled part having been "set" at an angle of approximately 35° to the plane containing the remainder of the element. The width of the angled edge portion decreases from the extreme end of each blade to a point at which it runs out at or in the region of the pivot (and in this particular embodiment the cutting elements are shown to have serrated edges).

The blade 10 has a screwthreaded bush 20 moulded in it for the reception of the pivot screw 22. The blade 12 has been moulded with a hole 24 and counterbore 26 for the reception of the pivot head of the screw 22.

A pair of co-operating spring steel elements 28 and 30 of rectangular outline shape are provided between the blades, and the latter are recessed at 29 for the reception of said elements. The elements 28 and 30 both have a hole 32 through which the pivot screw 22 can extend. In addition, the element 30 is formed with a "ride" portion stamped into it, that is to say a shallow projection 35 which extends arcuately around the hole 32. In its free condition as shown in the drawing, the spring steel element 30 is of arched form and the arrangement is such that when the scissors are assembled the pressure which is applied by the "ride" of the spring steel element 30 maintains the blades in mutual contact in the manner of the ride commonly provided integrally of the pivoted blade and shank portions of conventional scissors.

It will be understood that the production of the pair of scissors described above will have involved the initial steps of forming the metal cutting elements from flat metal strip and locating them in the dies in which the scissor blades are subsequently to be moulded, integral with their respective shanks and bows. This initial forming of the cutting elements may conveniently be carried out by stamping, when the marginal edge portion can simultaneously be set relative to the remainder of each cutting element. (This setting, see FIGS. 2 to 6, is very important and replaces the relatively expensive process of hollow grinding and ride adjusting of a conventional pair of steel bladed scissors). Holes 34 which are to coincide with the pivot of the finished scissors and further holes 36 through which the synthetic plastics material will flow to assist in keying the cutting elements in the finished blades, may also be stamped during the initial forming of said elements.

Referring now to FIGS. 7 to 10, there is illustrated another pair of scissors embodying the invention and similar to the scissors described with reference to FIGS. 1 to 6. However, it will be seen that in this case the metal cutting elements 14 extend beyond the ends of the moulded parts of the blades and the projecting portions 38 of said cutting elements facilitate a "pick-up" action on work materials. As shown in FIG. 10, the metal cutting elements 14 have been provided with irregular shaped holes 36 for the flow of the synthetic plastics materials therethrough and, as indicated by the chain-dotted line in FIG. 10, the extreme ends of the moulded parts of the blades coincide with the extreme edge portions of the endmost holes 36 so that the extreme end portions of the moulded parts on opposite sides of each cutting element are joined together through said endmost hole and are unlikely to break away as they would be if they were unconnected.

The metal cutting element illustrated in FIG. 10 is that moulded into the blade 10 of the pair of scissors just described and is shown to be provided with a relatively short portion 40 extending beyond the pivot so that it extends into and strengthens the associated shank. However, the similar portion 40 which extends beyond the pivot in the blade 12 and into its associated shank is shown to be relatively longer according to the relatively longer length of said shank.

The rather different form of metal cutting element illustrated in FIG. 11 is shown to have holes 36 which break out along the edge remote from the cutting edge so that they form spaced notches along that edge, but it will be seen that an endmost one of said holes is again shaped so as substantially to coincide with the extreme end portions of the moulded parts of the finished blade as shown by the chain-dotted line.

The metal cutting element illustrated in FIGS. 12 and 13 is shown to have a series of smaller holes 36 as in the first described embodiment (but it will be understood that in fact this is merely a matter of choice and that various arrangements of holes, regular or irregular, may be provided in the cutting elements). A more significant difference in the element illustrated in FIGS. 12 and 13 is the fact that the portion 40 (which extends beyond the pivot so that in the finished blade it extends into the associated shank) has been doubled over to form a "ride" portion 42 of the blade. It will be understood that if such a form of metal cutting element is provided in one or other of the blades (and of course the portion 40 thereof may be folded one way or the other depending on which blade it is to be moulded into) the spring steel element 30 shown in FIGS. 1 to 7 will not be required.

Figure 14:
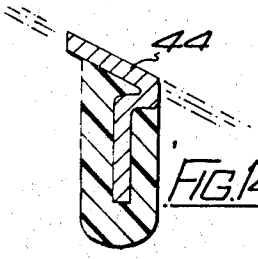
Figure 15:
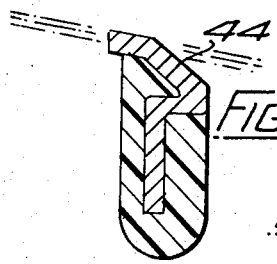

FIGS. 14 and 15 are enlarged sectional views of moulded blades incorporating metal cutting elements which are not merely provided with angled marginal edge portions 16 but which have been pressed into a shape such that the parts which form anchorage portions can be moulded substantially centrally within the moulded parts of the blades, as shown, but such that parts 44 adjacent the cutting edges form a protective metal face across the entire thickness of the finished blade. The metal faces can be ground, as indicated by the chain-dotted lines, to sharpen the blades. The cross sectional shape of the cutting element in FIG. 14 is shown to be such that the whole of the protective metal face extends at the angle at which the cutting edge is sharpened. The cross sectional shape of the cutting element in FIG. 15 on the other hand is such that only a relatively narrow strip immediately adjacent the cutting edge extends at the angle at which the cutting edge is sharpened, the remainder of the metal face across the thickness of the blade being at a "backed-off" angle as shown. For certain materials this form of blade is preferred because it cuts down the frictional resistance to cutting.

Figure 16:
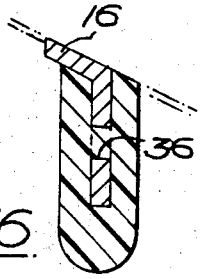

In FIG. 16 there is illustrated to an enlarged scale the cross sectional shape of one of the blades of the scissors illustrated in FIG. 7. This is of course provided with the angled edge portion 16 previously described but, as indicated by the chain-dotted lines, this has been sharpened by grinding and the grinding has extended across a part of the plastics blade not faced by a part of the cutting element. In FIG. 16 the synthetic plastics material is seen to have flowed through one of the holes 36 in the cutting element to "key" the latter within the blade (and of course it will be understood that the holes may be such as those illustrated in any of the drawings previously referred to, that is to say they may be circular holes or irregular holes or slots — which may or may not break out at the edges remote from the cutting edges of the cutting elements — or may be any combination of these).

Various other modifications may be made without departing from the scope of the invention. For example, instead of the screwthreaded bush 20 being moulded in one of the blades for the reception of the pivot screw, one of the cutting elements could be provided with a screw-threaded hole for the reception of said screw before being located in the die concerned, and of course it will be understood that since the cutting elements may be made of a relatively thin steel strip the cutting element can be punched at that point so that the effective length of the hole is greater than the thickness of the strip before it is screwthreaded. It will also be understood that the cutting edges of the moulded-in cutting elements may either be plain or serrated; in fact, if desired one could be plain and the other serrated. The cutting elements need not necessarily by made of flat steel strip; they could be of cast or forged construction and of course in this case could vary in thickness throughout their section and length.

What I claim and desire to secure by Letters Patent is:

1. A pair of scissors having a pair of pivotally connected blades; each blade being made of a moulded plastics material with an integrally moulded-in metal cutting element so that only the marginal edge portions of said cutting elements are visible, the marginal edge portion of each cutting element being angled out of the plane of the remainder of such element and the depth of the angled portion decreasing from the extreme end of the blade to a point at which it runs out in the region of the pivot connecting the blades, the angled portion of each cutting element being an angle of up to 90° to the plane containing the remainder of the cutting element; the metal cutting elements each being provided with at least one aperture for the flow of moulding material therethrough; the moulded material having flowed through said apertures of the cutting elements during the molding step to unite the moulded parts of the blades on opposite sides of the cutting elements by bridges of molded plastics material integral therewith and to thereby form blades of substantially sandwich construction.

2. A pair of scissors according to claim 1, in which the angled portion of each cutting element is set at an angle of up to 90° to a plane containing the remainder of the element.

3. A pair of scissors according to claim 1, in which the metal cutting elements extend beyond the ends of the moulded parts of the blades to facilitate a pick-up action on work materials, and in which the extreme ends of the moulded parts of the blades coincide with extreme edge portions of the apertures in the cutting elements so that the extreme end portions of the moulded parts on opposite sides of each cutting element are joined together.

4. A pair of scissors according to claim 1, in which the metal cutting elements are formed with portions which extend beyond the pivot and into shank portions to strengthen said shank portions, the extended portion of at least one of the cutting elements being doubled over and breaking out from the moulded part of the blade connected thereto to form a ride portion of the blade.

5. A pair of scissors according to claim 1, in which the extended portion of at least one of the cutting elements is doubled over to form a ride portion of the blade concerned.

* * * * *